US007683544B2

(12) United States Patent
Han

(10) Patent No.: US 7,683,544 B2
(45) Date of Patent: Mar. 23, 2010

(54) PLASMA DISPLAY PANEL HAVING BUFFER AREAS ALONG THE PERIPHERY OF DISPLAY AREA

(75) Inventor: Seong-Hoon Han, Yongin-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 564 days.

(21) Appl. No.: 11/529,873

(22) Filed: Sep. 29, 2006

(65) Prior Publication Data

US 2007/0170864 A1 Jul. 26, 2007

(30) Foreign Application Priority Data

Sep. 29, 2005 (KR) ..... 10-2005-0091201

(51) Int. Cl.
*H01J 17/49* (2006.01)

(52) U.S. Cl. ..... 313/582; 313/585; 345/60

(58) Field of Classification Search ..... 313/582–587; 345/60

See application file for complete search history.

(56) References Cited

U.S. PATENT DOCUMENTS

| | | | | |
|---|---|---|---|---|
| 2004/0056597 | A1 | 3/2004 | Ko et al. | |
| 2004/0075389 | A1 | 4/2004 | Kim et al. | |
| 2005/0104519 | A1 | 5/2005 | Jeon | |
| 2005/0116643 | A1 | 6/2005 | Chang et al. | |
| 2006/0043894 | A1 * | 3/2006 | Kim et al. | 313/586 |
| 2006/0125396 | A1 * | 6/2006 | Han et al. | 313/582 |
| 2006/0202619 | A1 * | 9/2006 | Kim | 313/582 |

FOREIGN PATENT DOCUMENTS

| | | | |
|---|---|---|---|
| CN | 1617286 | A | 5/2005 |
| JP | 11-007890 | | 1/1999 |
| JP | 2003-245596 | | 9/2003 |
| JP | 2004-103249 | | 4/2004 |
| JP | 2004-103562 | | 4/2004 |
| KR | 10-2004-0021399 | A | 3/2004 |
| KR | 10-2005-0051347 | A | 6/2005 |
| WO | WO 02/084689 | A1 | 10/2002 |

OTHER PUBLICATIONS

European Search Report dated May 8, 2008 for corresponding European Patent Application No. 06121509.1, indicating relevance of the cited references.

(Continued)

*Primary Examiner*—Karabi Guharay
(74) *Attorney, Agent, or Firm*—Christie, Parker & Hale, LLP

(57) ABSTRACT

A plasma display panel has heights of barrier ribs prevented from abnormally increasing at positions where a phosphor dispensing process starts and ends, improving discharge performance and uniformity of a panel. A front substrate and a rear substrate face each other. Address electrodes and display electrodes extend separately from each other in a first direction and a second direction, respectively, in a space between the front substrate and the rear substrate, the first direction crossing the second direction. Barrier ribs partition a display area including a plurality of discharge cells in the space between the front substrate and the rear substrate. A non-display area is formed along a periphery of the display area. A phosphor layer is formed in each discharge cell. The non-display area includes a buffer area formed of at least a single region outside the display area.

22 Claims, 12 Drawing Sheets
(4 of 12 Drawing Sheet(s) Filed in Color)

OTHER PUBLICATIONS

Korean Patent Abstracts, KR10-2005-0051347A, Jun. 1, 2005, Byung S. Jeon, 1 pg.

Korean Patent Abstracts, KR10-2004-0021399A, Mar. 10, 2004, Huh et al., 1 pg.

* cited by examiner

PLASMA DISPLAY PANEL HAVING BUFFER AREAS ALONG THE PERIPHERY OF DISPLAY AREA

CROSS-REFERENCE TO RELATED APPLICATION

This application claims priority to and the benefit of Korean Patent Application No. 10-2005-0091201 filed in the Korean Intellectual Property Office on Sep. 29, 2005, the entire content of which is incorporated herein by reference.

BACKGROUND OF THE INVENTION

1. Field of the Invention

The present invention relates to a plasma display panel (PDP), and more particularly, to a PDP that prevents heights of barrier ribs from abnormally increasing at positions where a phosphor dispensing process starts and ends so as to improve discharge performance and uniformity of a panel.

2. Description of the Related Art

In general, a PDP forms images by using visible ray emitted from phosphors excited due to plasma discharge. In the PDP, a predetermined voltage is applied to electrodes provided in a discharge space, so that plasma discharge occurs between the electrodes. Phosphor layers having predetermined patterns are excited due to vacuum ultraviolet (VUV) rays generated during the plasma discharge. The PDP forms images by using the visible ray generated when the phosphor layers are stabilized.

The PDP includes a rear substrate, a plurality of address electrodes formed on the rear substrate, a dielectric layer covering the address electrodes, a plurality of barrier ribs that are formed on the dielectric layer so as to keep a discharging gap and prevent cross talk generated between discharge cells, and a phosphor layer formed on the surfaces of the barrier ribs.

Further, the PDP includes a front substrate, discharging electrodes formed on the front substrate, a dielectric layer covering the discharging electrodes, and a protective layer covering the dielectric layer. The discharging electrodes are separated from the address electrodes with a predetermined gap and have a direction which is substantially perpendicular to the direction of the address electrodes.

The front substrate and the rear substrate are sealed to each other, and inert gas such as neon (Ne) and xenon (Xe) is filled in the discharge cell. The inert gas generates the VUV rays during the plasma discharge.

The barrier ribs are formed on the rear substrate and the phosphor layer is then formed using, for example, a method of discharging a phosphor paste through a plurality of nozzles provided in a dispenser.

In the dispensing process, the phosphor paste injected from the nozzles is discharged onto dummy barrier ribs in a dummy area at positions where the dispensing process starts and ends. For this reason, the heights of the dummy barrier ribs become abnormally increased.

As the heights of the dummy barrier ribs abnormally increase at both edges, uniformity of a panel is lessened over the entire PDP in which the rear substrate and the front substrate are sealed to each other.

In addition, since the gap between the rear substrate and the front substrate is increased, cross talk occurs in the discharge cells of the display area that is adjacent to the positions where the dispensing process starts and ends and discharge performance deteriorates.

SUMMARY OF THE INVENTION

In accordance with the present invention a PDP is provided which prevents heights of barrier ribs from abnormally increasing at positions where a phosphor dispensing process starts and ends and improves discharge performance and uniformity of a panel.

An exemplary embodiment of the present invention provides a PDP that includes a front substrate and a rear substrate arranged to face each other. Address electrodes and display electrodes extend separately from each other in a first direction and a second direction, respectively, that cross each other, in a space between the front substrate and the rear substrate. Barrier ribs partition a display area having a plurality of discharge cells in the space between the front substrate and the rear substrate. A non-display area is formed along a periphery of the display area. A phosphor layer is formed in each discharge cell. The non-display area includes a buffer area formed of at least a single region outside the display area.

The buffer areas may be formed in the entire non-display area in the second direction.

Barrier rib members extending in the first direction may be absent from the buffer areas.

Phosphor mixed layers having different colors may be formed in the buffer areas so as to be adjacent to each other.

A height of the phosphor mixed layer may be smaller than an average height of the barrier ribs.

The buffer areas may be formed at both edges of the display area in the first direction.

The buffer area may include a first lateral barrier rib member in the second direction that forms a boundary between itself and the display area, a first longitudinal barrier rib member and a second longitudinal barrier rib member that are formed in the first direction at both edges of the first lateral barrier rib member, and a second lateral barrier rib member that is formed by connecting an end of the first longitudinal barrier rib member with an end of the second longitudinal barrier rib member.

Positions where the application of phosphor pastes starts and ends in a dispensing process may be positioned in the buffer areas formed at both edges of the display area in the first direction, respectively.

Another embodiment of the present invention provides a PDP that includes a front substrate and a rear substrate arranged to face each other. Address electrodes and display electrodes extend separately from each other in a first direction and a second direction crossing the first direction, respectively, in a space between the front substrate and the rear substrate. Barrier ribs partition a display area having a plurality of discharge cells in the space between the front substrate and the rear substrate. A non-display area is formed along a periphery of the display area. A phosphor layer is formed in each discharge cell. The non-display area includes buffer areas in which phosphor mixed layers having different colors are formed to be adjacent to each other.

The buffer areas may be formed from a boundary between the display area and themselves to a frit line formed along an edge of a portion in which the rear substrate and the front substrate overlap each other.

The buffer area may include a first lateral barrier rib member in the second direction that forms a boundary between itself and the display area, and a first longitudinal barrier rib member and a second longitudinal barrier rib member in the first direction that are formed at both edges of the first lateral barrier rib member.

Approaching the display area, a height of the phosphor mixed layer applied in the buffer area may be reduced from a maximum height.

A height of a phosphor mixed layer applied in the buffer area may be smaller than an average height of a longitudinal barrier rib member between the longitudinal barrier rib member and a lateral barrier rib member that form the barrier rib in the display area.

Yet another embodiment of the present invention provides a PDP that includes a front substrate and a rear substrate arranged to face each other. Address electrodes and display electrodes extend separately from each other in a space between the front substrate and the rear substrate. Barrier ribs form a display area. A non-display area is formed along a periphery of the display area. A plurality of discharge cells in the space between the front substrate and the rear substrate are partitioned. A phosphor layer is formed in each discharge cell. The non-display area includes dummy cells that have a width larger than or equal to a width of a pair of discharge cells adjacent to the dummy cells in the first direction.

Further away from the display area, the dummy cells may have a larger width.

The non-display area may include first buffer areas formed of dummy cells that are adjacent to the display area and each have the same width as a unit width of the discharge cells. Second buffer areas are formed of dummy cells that are adjacent to the first buffer areas and each have a width larger than the width of each of the dummy cells included in the first buffer areas. Third buffer areas are formed of dummy cells that are adjacent to the second buffer areas and each have a width larger than the width of each of the dummy cells included in the second buffer areas.

Each of the third buffer areas may be formed of one dummy cell.

A length of each first buffer area in the first direction may be equal to a length of the discharge cell of the display area in the first direction.

A length of each second buffer area in the first direction may be equal to a length of the discharge cell of the display area in the first direction.

A length of each third buffer area in the first direction may be larger than a length of the discharge cell of the display area in the first direction.

The third buffer areas may be formed at both edges of the non-display area in the first direction.

Positions where the application of phosphor pastes starts and ends in a dispensing process may be positioned in the third buffer areas formed at both edges of the non-display area in the first direction, respectively.

Phosphor mixed layers having different colors may be formed in the buffer areas so as to be adjacent to each other.

Positions where the application of phosphor pastes starts and ends in a dispensing process may be positioned in the dummy cells formed at both edges of the display area in the first direction, respectively.

As described above, according to the PDP of the present invention, buffer areas formed of a single region are provided in a non-display area formed along the periphery of a display area, and positions where a phosphor dispensing process starts and ends are positioned in the buffer areas, respectively. Accordingly, it is possible to prevent heights of barrier ribs from abnormally increasing at the positions where a phosphor dispensing process starts and ends. As a result, cross talk is prevented in discharge cells of the display area adjacent to the non-display area, thereby improving discharge performance and uniformity of a panel.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION

Figure 1:
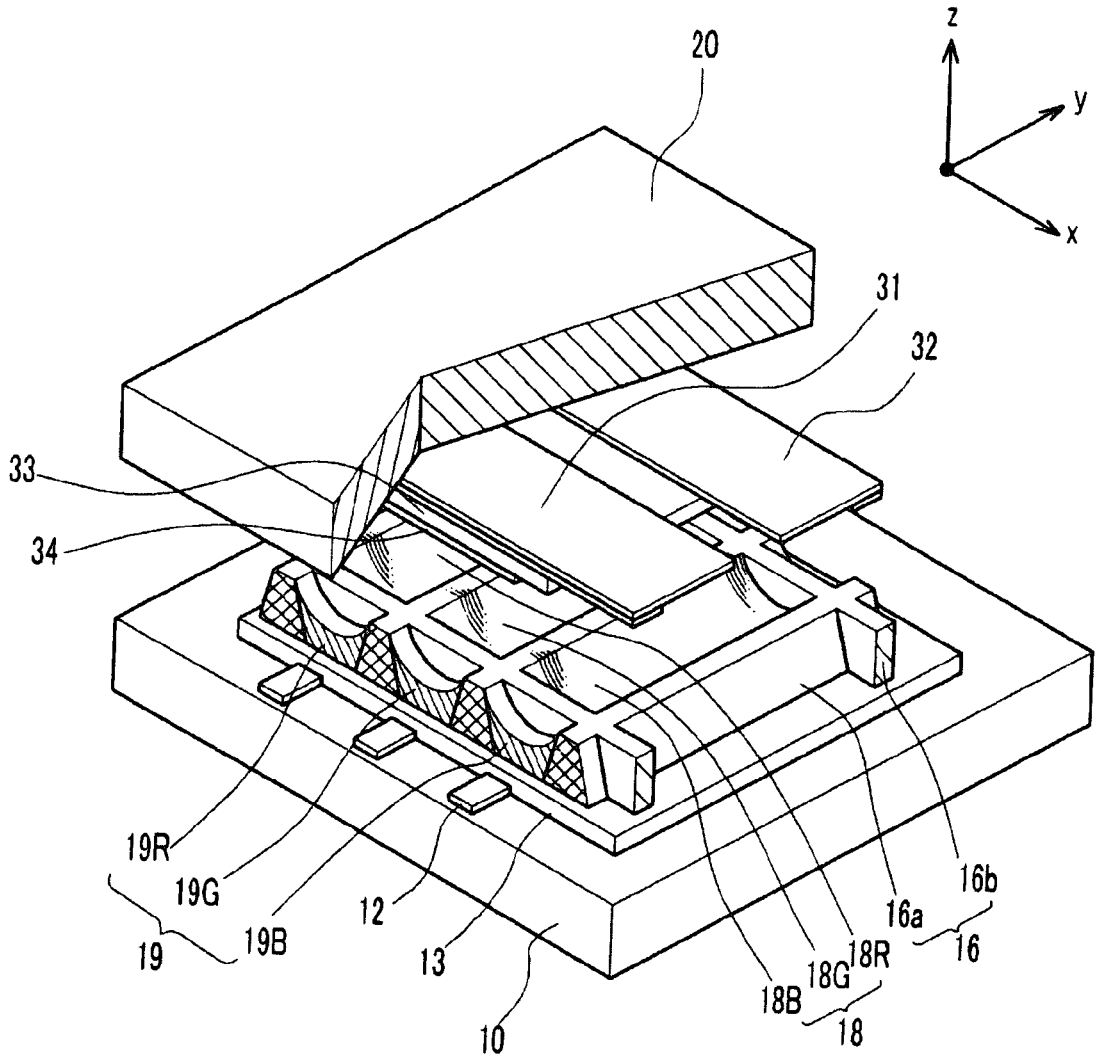
FIG. 1 is an exploded perspective view of a portion of a PDP according to a first exemplary embodiment of the present invention.
Figure 2A:
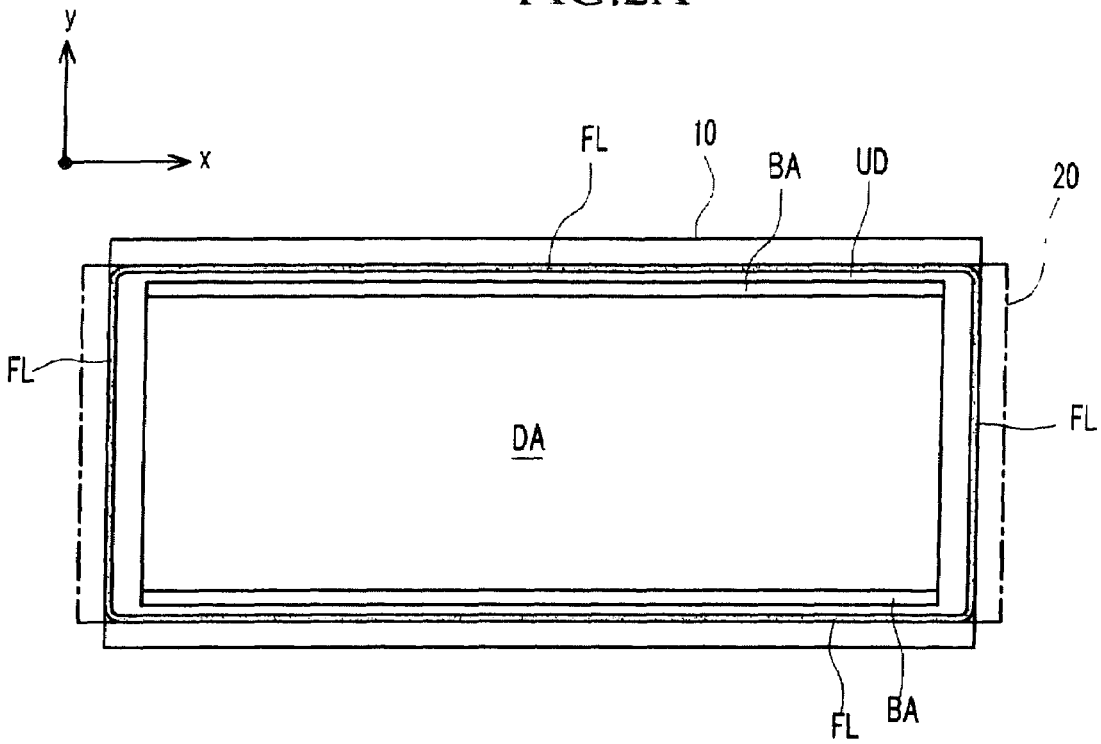
FIG. 2A is a plan view of the PDP according to the first exemplary embodiment of the present invention.
Figure 2B:
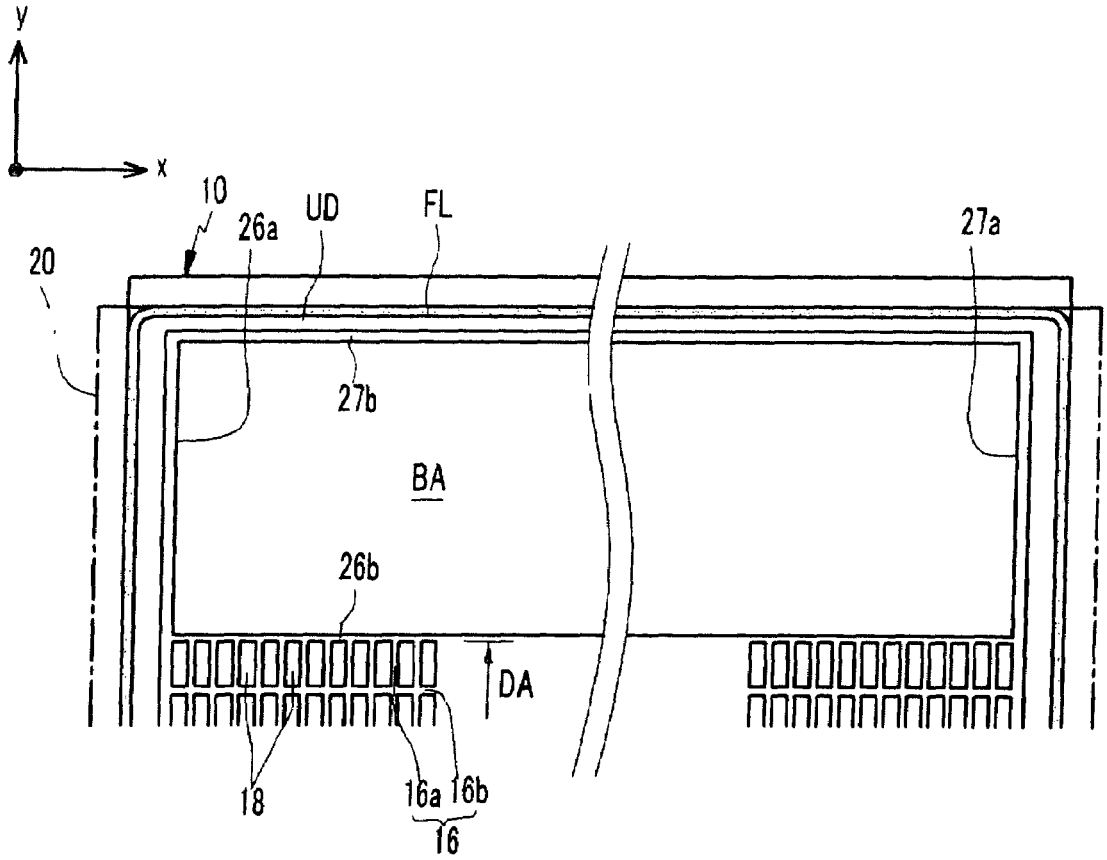
FIG. 2B an enlarged plan view of a portion of a rear substrate of the PDP according to the first exemplary embodiment of the present invention.

Referring to FIGS. 1, 2A and 2B, the PDP includes a rear substrate 10 and a front substrate 20 that are disposed substantially parallel to each other with a predetermined gap therebetween. The rear substrate 10 and the front substrate 20 are sealed to each other with a barrier rib 16 interposed therebetween. The barrier rib 16 partitions discharge cells 18 between the substrates 10, 20. A phosphor layer 19 that absorbs a VUV ray and emits visible light is formed in the discharge cells 18, and a discharge gas (for example, a mixed gas that includes Ne, Xe, and the like) is filled in the discharge cells 18.

The barrier rib 16 may partition the discharge cells 18 so that the discharge cells 18 have a stripe structure (not shown) or a matrix structure (as seen in FIG. 1). In the stripe structure, the barrier rib 16 would be formed of longitudinal barrier rib members extending in a first direction (y-axis direction). In the matrix structure, the barrier rib 16 is formed of longitudinal barrier rib members 16*a* extending in the y-axis direction and lateral barrier rib members 16*b* extending in a second direction (x-axis direction) crossing the longitudinal barrier rib member 16*a*.

Each of the discharge cells 18 is provided with address electrodes 12 and a pair of display electrodes 31, 32 that are provided in the y-axis direction and the x-axis direction, respectively, crossing each other. Accordingly, a specific discharge cell 18 is selected among the discharge cells 18 partitioned by the barrier rib 16 and the selected discharge cell 18 is driven to form an image.

The address electrodes 12 are formed on the rear substrate 10 and extend in the y-axis direction so as to correspond to the discharge cells 18. Further, the address electrodes 12 are covered with a dielectric layer 13. The display electrodes 31, 32 are formed on the front substrate 20 distal from the address electrodes 12 in a third direction (z-axis direction), and extend in the x-axis direction crossing the y-axis direction. Further, the display electrodes 31, 32 are covered with a dielectric layer 33 and a protective layer 34.

Referring to FIGS. 2A and 2B, the PDP includes a display area DA that includes a plurality of discharge cells 18 that form an image as described above, and a non-display area UD that is formed along the periphery of the display area DA and does not form an image.

In the PDP, the non-display area UD may refer to an entire area except for the display area DA. However, a non-display area UD in this embodiment substantially refers to a region formed at both edges of the display area DA in the y-axis direction.

The rear substrate 10 and the front substrate 20 are disposed to have an overlapping portion in which the rear substrate 10 and the front substrate 20 overlap each other and a non-overlapping portion in which the rear substrate 10 and the front substrate 20 do not overlap each other. The rear substrate 10 and the front substrate 20 are attached to each other along a frit line FL that is formed on a boundary between the overlapping portion and the non-overlapping portion.

Phosphor layers 19R, 19G, 19B that emit red (R), green (G), or blue (B) visible light are formed in the discharge cells 18R, 18G, 18B of the display area DA, respectively. Phosphor pastes are applied on the discharge cells 18R, 18G, 18B in a phosphor dispensing process so as to form the phosphor layers 19R, 19G, 19B.

In the phosphor dispensing process, the application of the phosphor pastes starts from one edge of the non-display area UD in the y-axis direction and is finished at the other edge thereof. Accordingly, an excessive amount of the phosphor paste is discharged at both edges of the non-display area UD, that is, at a position where the application of the phosphor pastes starts or a position where the application thereof ends, due to the phosphor paste that is nonuniformly discharged.

Buffer areas BA are formed in the non-display area UD onto which the phosphor paste is nonuniformly discharged. The buffer areas BA may be formed at four sides of the display area DA that is formed in a substantially quadrangular shape. However, in this embodiment, as seen in FIG. 2A, the buffer areas BA are formed at two sides of the display area DA in the y-axis direction in which the phosphor paste is applied, that is, both edges in the y-axis direction. Each of the buffer areas BA is formed of a single region outside the display area DA so as to uniformly discharge the phosphor paste. The single region refers to the following structure. That is, a first longitudinal barrier rib member 26*a*, a second longitudinal barrier rib member 27*a*, a first lateral barrier rib member 26*b*, and a second lateral barrier rib member 27*b* are connected to each other so as to form a quadrangular shape and partition the buffer areas BA from the display area DA. A longitudinal barrier rib member (a barrier rib member extending in the y-axis direction) or a lateral barrier rib member (a barrier rib member extending in the x-axis direction) are not formed in the buffer areas BA.

Further, the buffer areas BA are formed in the entire range of the display area DA in the x-axis direction. Accordingly, it is possible to uniformly discharge the phosphor paste in the entire range of the display area DA in the x-axis direction. In this case, the first longitudinal barrier rib member 26*a* and the second longitudinal barrier rib member 27*a* are formed at both edges of display area DA in the x-axis direction, and extend in the y-axis direction. The first lateral barrier rib member 26*b* is formed on a boundary between the display area DA and each buffer area BA, and connects the end of the first longitudinal barrier rib member 26*a* with the end of the second longitudinal barrier rib member 27*a*.

Due to each of the buffer areas BA formed of the single region as described above, the amount of the phosphor paste applied on the dielectric layer 13 in the area defined by the first longitudinal barrier rib member 26*a*, the second longitudinal barrier rib member 27*a*, the first lateral barrier rib member 26*b*, and the second lateral barrier rib member 27*b* is larger than the amount of the phosphor paste to be discharged in the display area DA.

Figure 6:
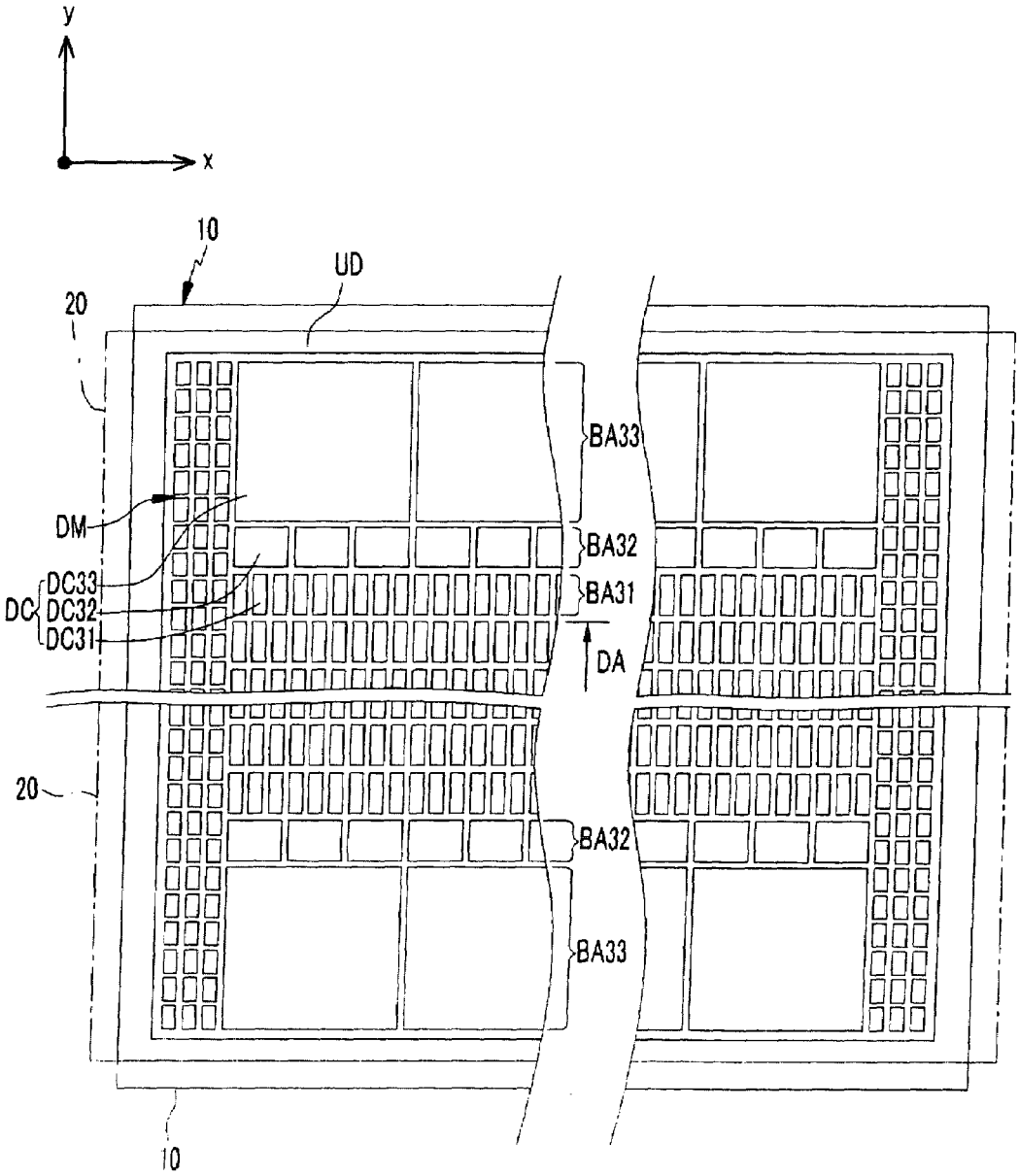
FIG. 6 is a plan view of upper and lower portion of a rear substrate of a PDP according to a fourth exemplary embodiment of the present invention.
Figure 7:
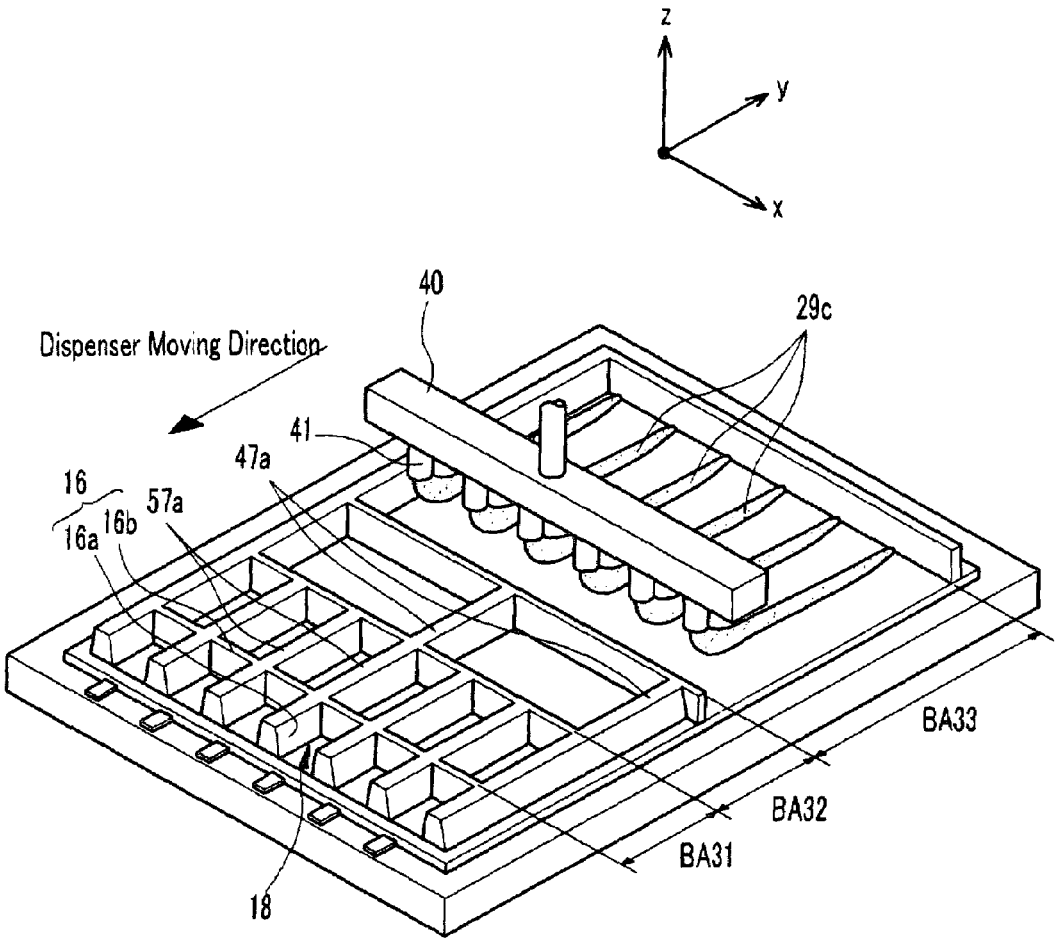
FIG. 7 is a perspective view illustrating a process for applying phosphor pastes on a portion of the rear substrate of the PDP according to the fourth exemplary embodiment of the present invention.

Since each of the buffer areas BA is formed of the single region, each of the buffer areas BA includes a phosphor mixed layer 29 (corresponding to a phosphor mixed layer 29 in a third buffer area BA33 shown in FIGS. 6 and 7). Different color phosphor pastes that are adjacent to each other in the x-axis direction and discharged are mixed in each buffer area BA. The phosphor pastes mixed as described above form the phosphor mixed layer 29. Thus, each buffer area BA includes a phosphor mixed layer 29 having phosphors corresponding to different colors touch each other.

The amount of the phosphor paste to be discharged in each buffer area BA is larger than that of the phosphor paste to be discharged in the display area DA. However, since each buffer area BA does not include a barrier rib member, the phosphor paste is not applied on the barrier rib member and exists on the dielectric layer 13 in the form of the phosphor mixed layer 29. The phosphor mixed layer 29 is formed to have a height smaller than the average height of the barrier rib 16 partitioning the discharge cells 18 in the display area DA (see FIG. 7). Thus, the phosphors corresponding to different colors in the phosphor mixed layer 29 touch each other at a position below an upper surface of the barrier ribs.

As described above, the height of the phosphor mixed layer 29 at both edges of the non-display area UD in the y-axis direction is smaller than that of the barrier rib 16 formed in the display area DA. In this state, when the rear substrate 10 and the front substrate 20 are attached to each other, the uniformity of a panel is improved over the entire panel. Further, a gap is reduced between the rear substrate 10 and the front substrate 20. As a result, cross talk is prevented and discharge performance is improved in the discharge cells 18 of the display area DA adjacent to portions of the non-display area UD where the phosphor dispensing process starts and ends.

Figure 3:
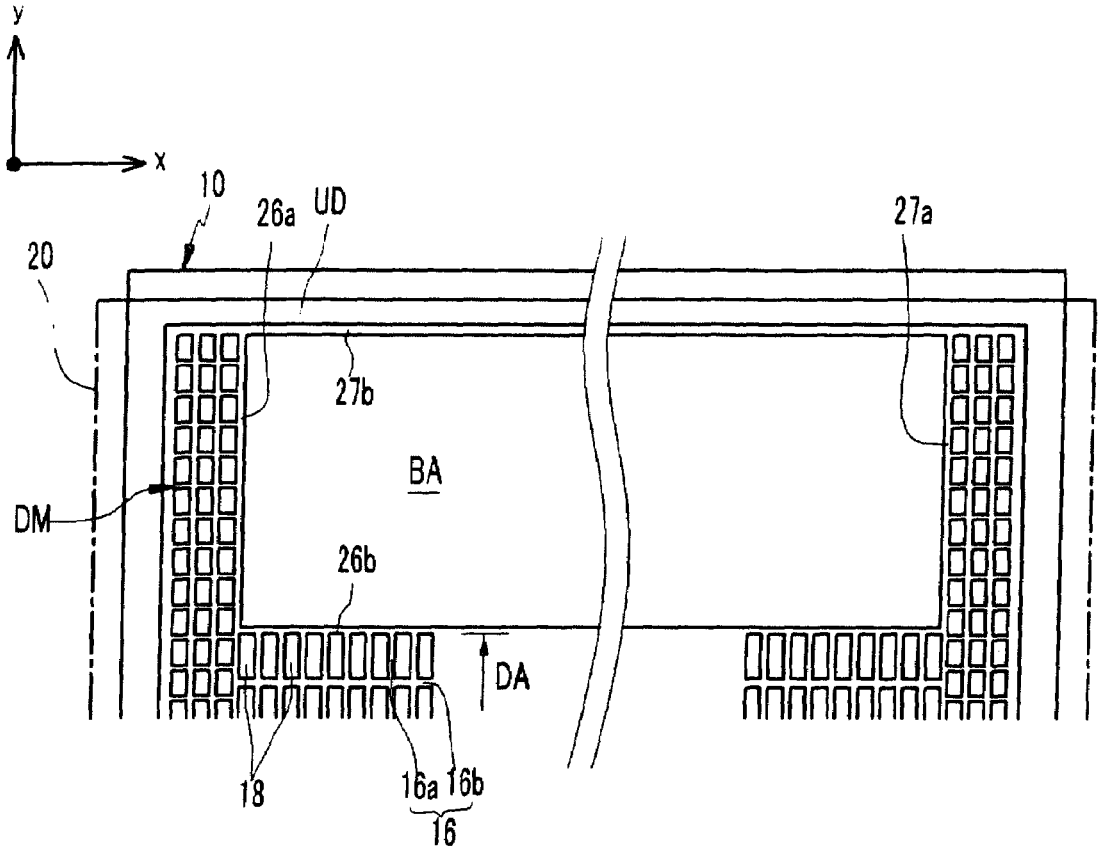
FIG. 3 is an enlarged plan view of a portion of a rear substrate of the PDP according to the second exemplary embodiment of the present invention.

Referring to FIG. 3, in a second exemplary embodiment, dummy areas DM are formed at both edges of the display area DA and the non-display area UD in the x-axis direction. The dummy areas DM prevent the deformation of the barrier ribs 16 defining the discharge cells 18 at both sides of the display area DA in the x-axis direction.

Hereinafter, various other exemplary embodiments of the present invention are further described. In these cases, the description of the same or similar elements as those in the first and second exemplary embodiments will be omitted, and elements different from those in the first and second exemplary embodiments will be described in detail.

Figure 4:
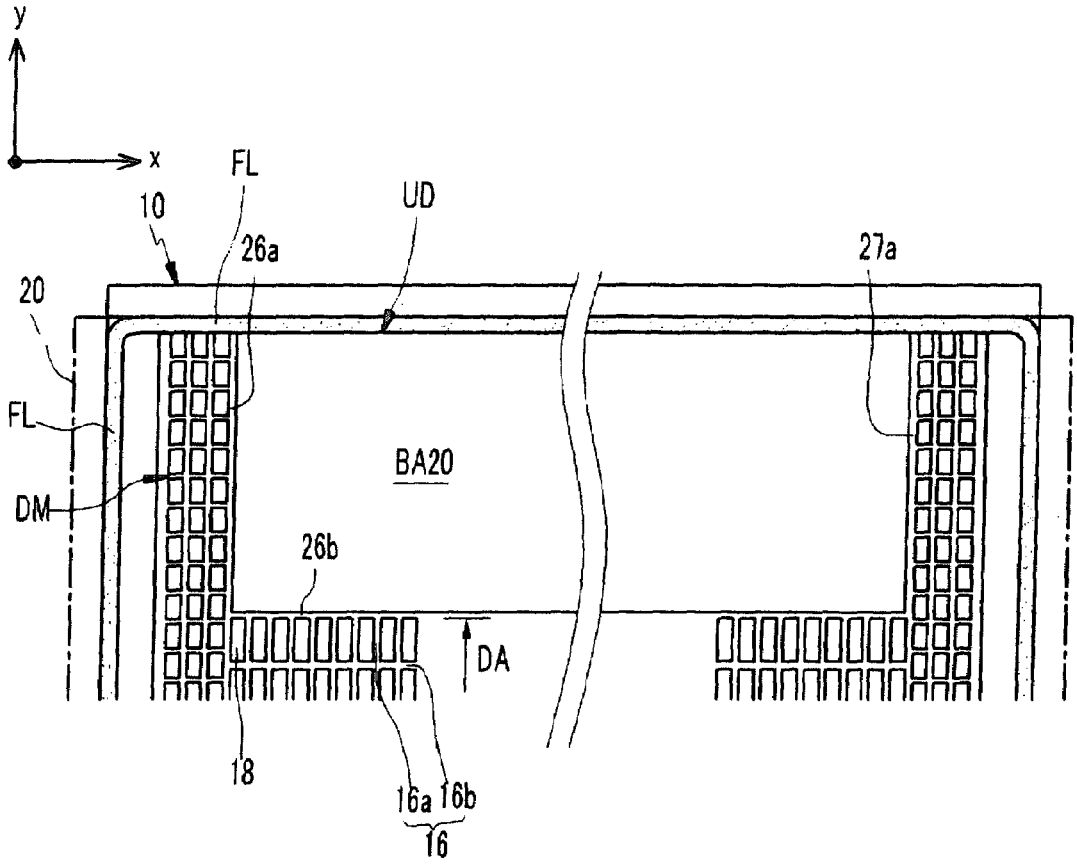
FIG. 4 is an enlarged plan view of a portion of a rear substrate and a frit portion of a PDP according to a third exemplary embodiment of the present invention.

FIG. 4 is an enlarged plan view of a portion of a rear substrate and a frit part of a PDP according to a third exemplary embodiment of the present invention.

Like the first exemplary embodiment, buffer areas BA20 on which a phosphor mixed layer 29 is formed are provided in a third exemplary embodiment. In addition, unlike the first exemplary embodiment, each of the buffer areas BA20 extend from the boundary between the display area DA and each buffer area BA20 to a frit line FL.

Even in the third exemplary embodiment, the buffer areas BA20 are formed at both edges of the display area DA in the y-axis direction. In this case, each of the buffer areas BA20 is partitioned by a first longitudinal barrier rib member 26*a*, a second longitudinal barrier rib member 27*a*, and a first lateral barrier rib member 26*b*.

That is, each buffer area BA20 has a structure in which three sides are connected to each other at right angles and a side furthest from the display area DA is open. The open side of each buffer area BA20 is formed of a frit line FL. Accordingly, each buffer area BA20 is partitioned by the first longitudinal barrier rib member 26*a*, the second longitudinal barrier rib member 27*a*, the first lateral barrier rib member 26*b*, and the frit line FL that are connected to each other, and forms a single region.

Each of the buffer areas BA20 forms a single region, and a phosphor mixed layer 29 is applied on each buffer area BA20 like the first exemplary embodiment. The height of the phosphor mixed layer 29 is smaller than the average height of the barrier rib 16 partitioning the discharge cells 18 in the display area DA as described above.

As compared with the first exemplary embodiment that includes the front substrate 20 and the rear substrate 10 having the same size as the front substrate 20, each buffer area BA20 of the third exemplary embodiment does not include the second lateral barrier rib member 27*b* and is partitioned by the frit line FL further away from the display area DA than the second lateral barrier rib member 27*b*. Accordingly, when the phosphor paste is discharged in the phosphor dispensing process, it is possible to more effectively control the amount of the phosphor paste to be discharged.

Further, according to the third exemplary embodiment, it is possible to reduce a gap between the front substrate 20 and the rear substrate 10 in the non-display area UD, which corresponds to the phosphor paste discharged onto the second lateral barrier rib member 27*b* of the first exemplary embodiment. For this reason, it is possible to further improve the uniformity of a panel.

Furthermore, as substantially approaching from the non-display area UD toward the display area DA in each buffer area BA20 formed of a single region, the height of the phosphor mixed layer 29 is reduced from the maximum height.

The height of the phosphor mixed layer 29 is smaller than the average height of the longitudinal barrier rib member 16*a* between the longitudinal barrier rib member 16*a* and the lateral barrier rib member 16*b* that form the barrier rib 16 in the display area DA.

Figure 5:
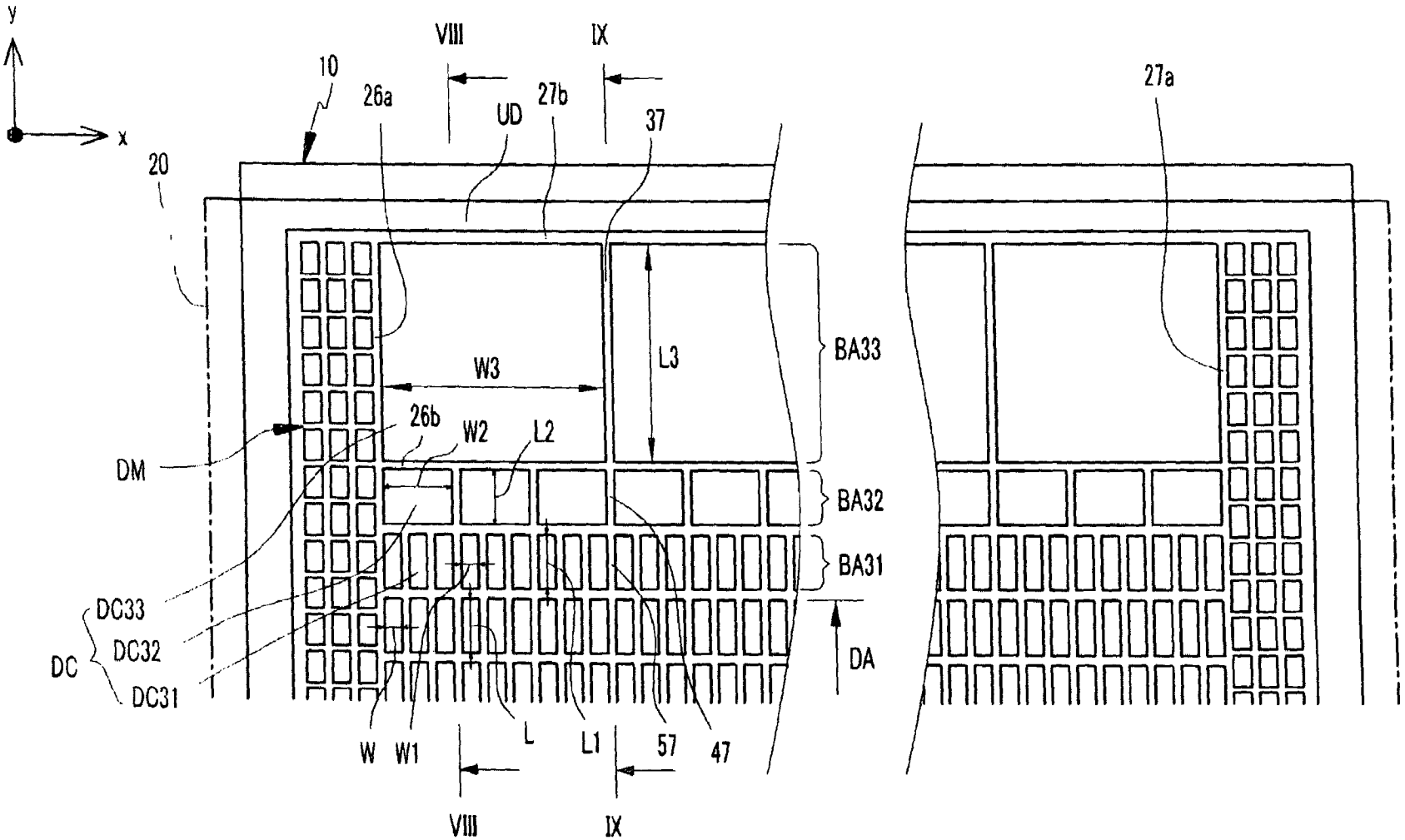
FIG. 5 is an enlarged plan view of a portion of a rear substrate of a PDP according to a fourth exemplary embodiment of the present invention.

FIG. 5 is an enlarged plan view of a portion of a rear substrate of a PDP according to a fourth exemplary embodiment of the present invention.

Referring to FIG. 5, the fourth exemplary embodiment includes dummy cells 20 DC in the non-display area UD. Each of the widths W2, W3 of the dummy cells DC is equal to or larger than the sum (W+W) of the widths of a pair of discharge cells 18 that is adjacent to each other in the x-axis direction. As the dummy cells DC are further away from the display area DA, the widths of the dummy cells DC may become larger (W1<W2<W3).

The non-display area UD includes a plurality of buffer areas, that is, first buffer areas BA31, second buffer areas BA32, and third buffer areas BA33 in this order from the display area DA. Each first buffer area BA31 includes dummy cells DC31 that are adjacent to the display area DA and each have the same width W1 as a unit width W of the discharge cells 18. Each second buffer area BA32 includes dummy cells DC32 that are adjacent to the first buffer area BA31 and each have a width W2 larger than the width W1 of each of the dummy cells DC31 included in the first buffer area BA31. Each third buffer area BA33 includes dummy cells DC33 that are adjacent to the second buffer area BA32 and each have a width W3 larger than the width W2 of each of the dummy cells DC32 included in the second buffer area BA32. Further, each third buffer area BA33 is formed by a single region (similar to that shown in FIGS. 3 and 4).

In addition, a length L1 of the dummy cell in the y-axis direction in the first buffer area BA31 is equal to a length L of the discharge cell 18 in the y-axis direction in the display area DA. A length L2 of the dummy cell in the y-axis direction in the second buffer area BA32 is equal to the length L of the discharge cell 18 in the y-axis direction in the display area DA. A length L3 of the dummy cell in the y-axis direction in the third buffer area BA33 is larger than the length L of the discharge cell 18 in the y-axis direction in the display area DA. As the dummy cell is further away from the display area DA, the lengths of the dummy cells may become larger (L1<L2<L3).

Accordingly, the area of the first buffer area BA31, the area of the second buffer area BA32, and the area of the third buffer area BA33 are sequentially increased in this order. The increase in area as described above allows the buffer areas to more effectively receive the phosphor mixed layer 29, depending on the amount of the phosphor paste that is non-uniformly discharged. That is, the increase in area takes into consideration the fact that the phosphor is most nonuniformly discharged at positions where the phosphor is discharged and is comparatively uniformly discharged at a position close to the display area DA.

Referring to FIG. 6, the third buffer areas BA33 are formed at both edges of the second buffer area BA32 in the non-display area UD in the y-axis direction. Accordingly, positions where the application of the phosphor pastes starts and ends in a dispensing process are positioned in the third buffer areas BA33 formed at both edges.

FIG. 7 is a perspective view illustrating a process for applying phosphor pastes on a portion of the rear substrate of the PDP according to the fourth exemplary embodiment of the present invention. The process of applying phosphor pastes will be described using the fourth exemplary embodiment as an example.

While a dispenser 40 is moved on a rear substrate 10 having a barrier rib 16 in the y-axis direction, phosphor pastes are applied through nozzles 41 provided in the dispenser 40.

In the phosphor dispensing process, since application of the phosphor pastes starts from the third buffer area BA33 in the non-display area UD and sequentially progresses to the second buffer area BA32 and the first buffer area BA31, the phosphor paste can be uniformly discharged. In this case, the phosphor pastes having respective colors form the phosphor mixed layer 29 in the first, second, and third buffer areas BA31, BA32, BA33.

The phosphor pastes are uniformly discharged in the display area DA, so that the phosphor pastes are applied to the discharge cells 18 depending on the colors.

The application of the phosphor pastes progresses through the display area DA, and sequentially progresses to the first buffer area BA31, the second buffer area BA32, and the third buffer area BA33 of the non-display area UD. Then, the application of the phosphor pastes comes to an end. Further, the phosphor paste is nonuniformly discharged again. In this case, the phosphor pastes having respective colors form the phosphor mixed layer 29 in the first, second, and third buffer areas BA31, BA32, BA33.

Figure 8:
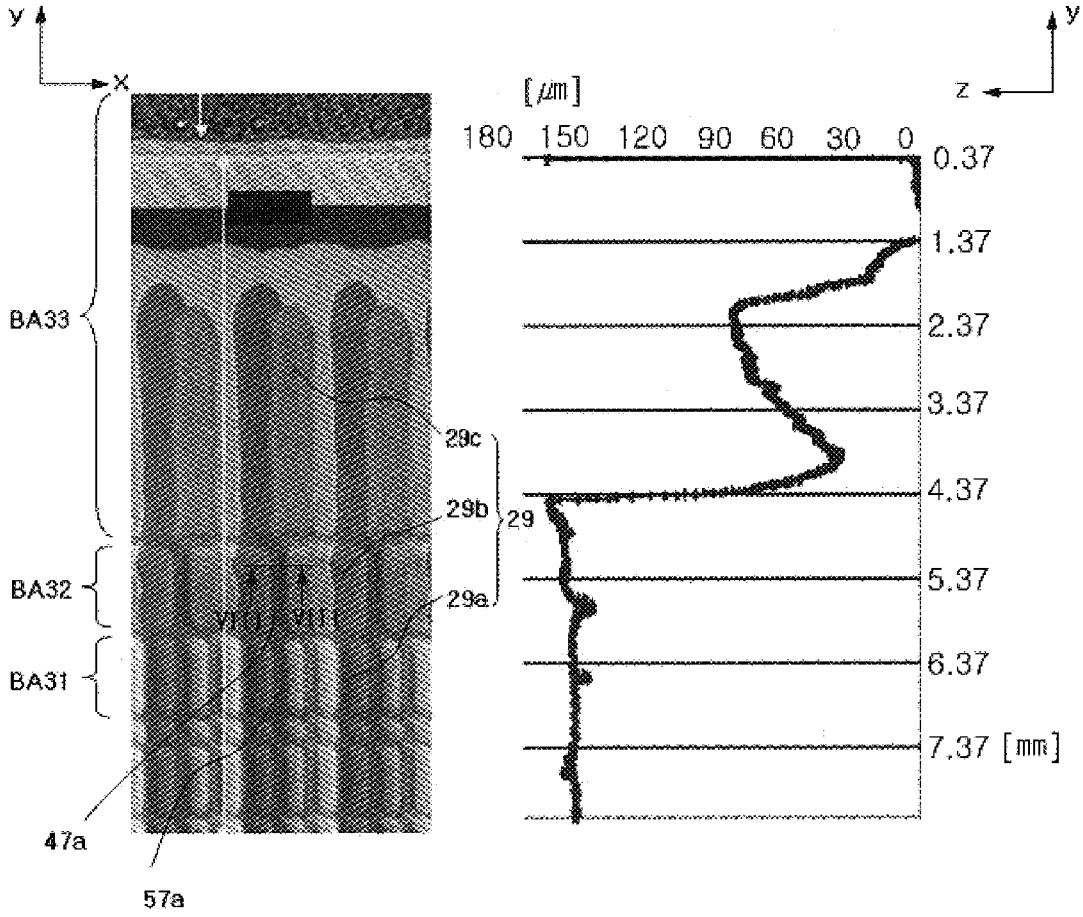
FIG. 8 is a plan view showing phosphor pastes applied to the rear substrate of the PDP according to the fourth exemplary embodiment of the present invention, and a corresponding graph showing a height profile taken along line VIII-VIII of FIG. 5 of a longitudinal barrier rib member and a phosphor mixed layer.

Referring to FIG. 8, since the third buffer area BA33 does not include longitudinal barrier rib members, the phosphor mixed layer 29 applied to the third buffer area BA33 of the rear substrate 10 has a minimum height at the start position of the application of the phosphor pastes and has a maximum height at a position close to the second buffer area BA32.

Thereafter, the phosphor pastes are mixed to each other in the second buffer area BA32 and the first buffer area BA31 and applied to the longitudinal barrier rib members 47*a*, 57*a*. As a result, the phosphor pastes form the phosphor mixed layer 29, and are applied to the discharge cells 18 in the display area DA with the uniform discharge amount.

Figure 9:
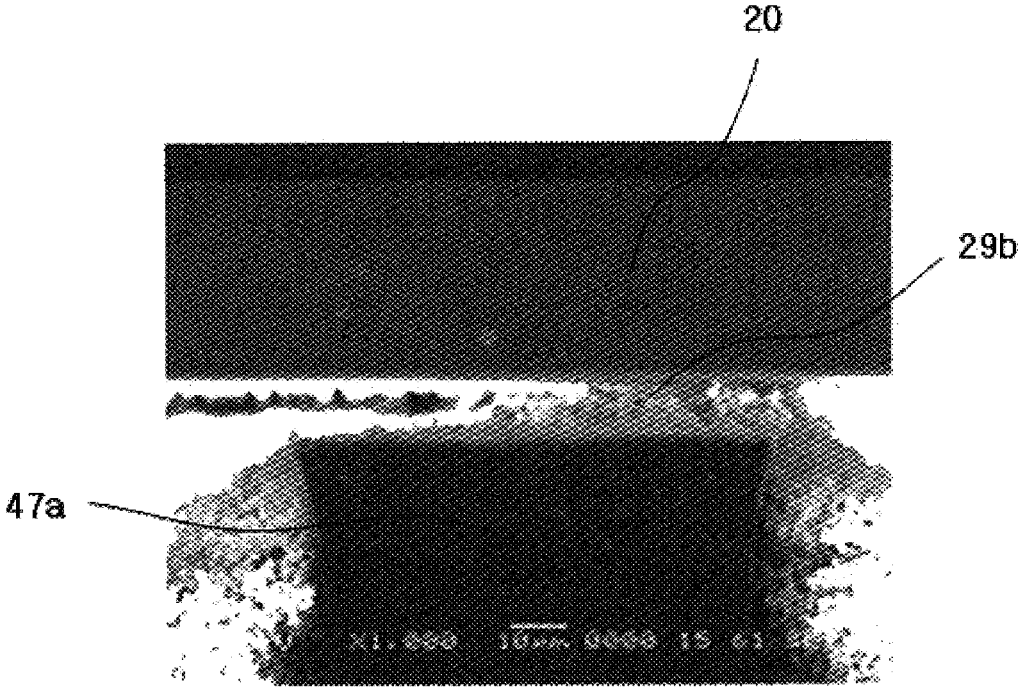
FIG. 9 is a cross-sectional view taken along line VIII-VIII of FIG. 8.

Referring to FIG. 9, the sum of the height of each longitudinal barrier rib member 47*a* and the height of the phosphor mixed layer 29*b* in the second buffer area BA32 is substantially equal to the height of each longitudinal barrier rib member 16*a* in the display area DA.

In this case, the height of the phosphor mixed layer 29*b* formed between the longitudinal barrier rib member 47*a* and the front substrate 20 is substantially equal to the height of the longitudinal barrier rib member 16*a* in the display area DA. Therefore, the gap between the front substrate 20 and the rear substrate 10 is set to be small.

Figure 10:
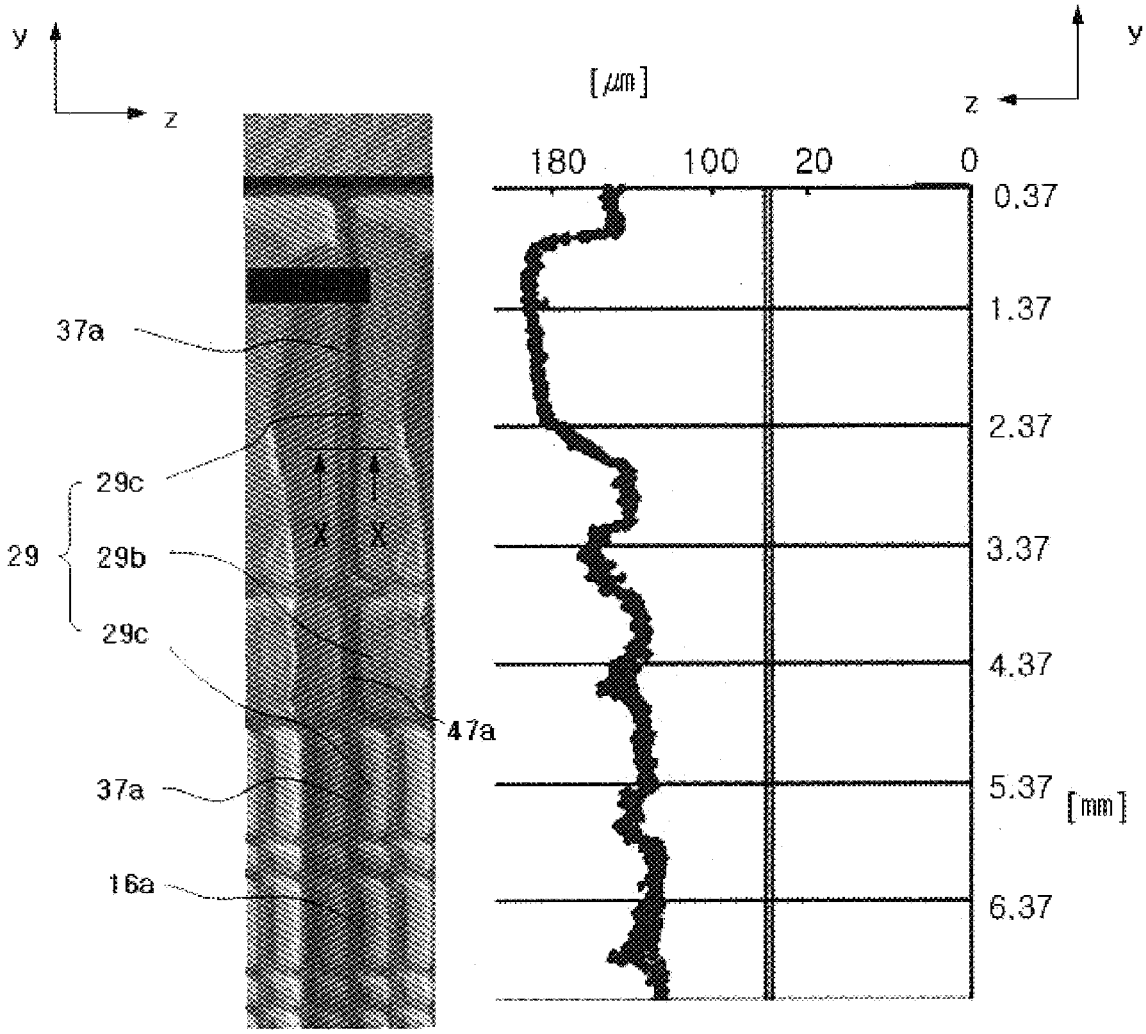
FIG. 10 is a plan view showing phosphor pastes applied to the rear substrate of the PDP according to the fourth exemplary embodiment of the present invention, and a corresponding graph showing a height profile taken along line IX-IX of FIG. 5 of the longitudinal barrier rib member and the phosphor mixed layer.

Referring to FIG. 10, since the third buffer area BA33 includes longitudinal barrier rib members 37*a*, the height of the phosphor mixed layer 29 applied to the third buffer area BA33 of the rear substrate 10 is larger than the phosphor mixed layer shown in FIG. 8 at the position where the application of the phosphor pastes starts.

Figure 11:
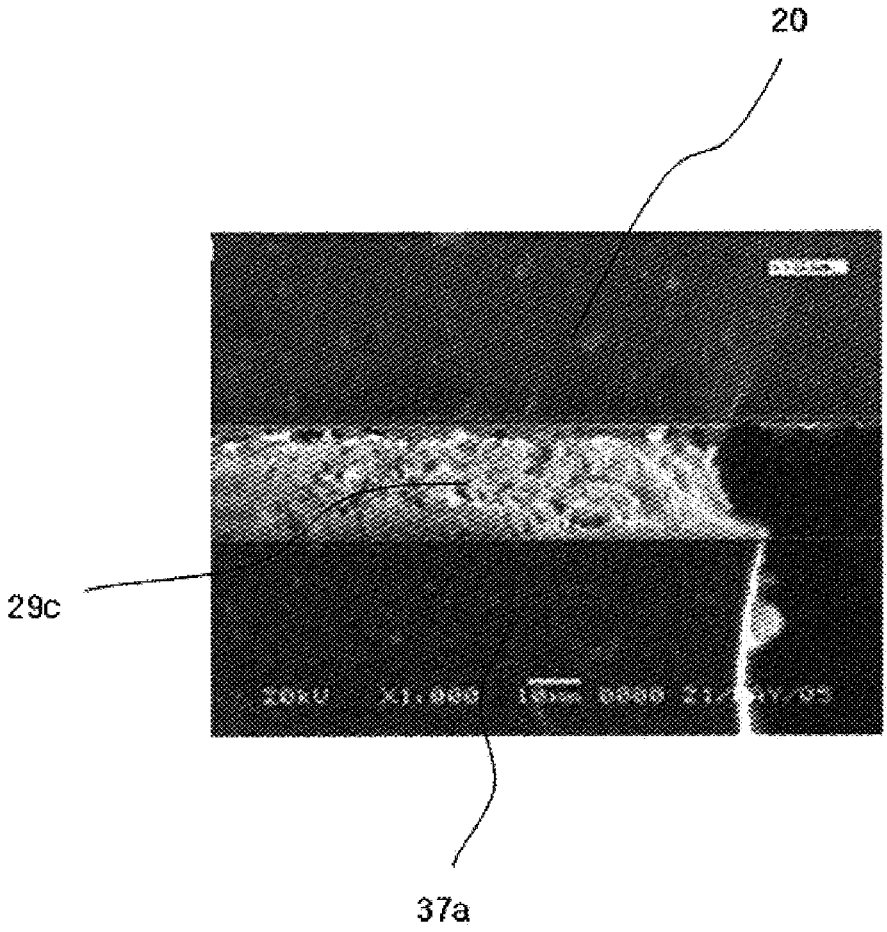
FIG. 11 is a cross-sectional view taken along line X-X of FIG. 10.

Referring to FIG. 11, the sum of the height of each longitudinal barrier rib member 37*a* and the height of the phosphor mixed layer 29*c* in the third buffer area BA33 is slightly larger than the height of each longitudinal barrier rib member 16*a* in the display area DA.

As described above, the fourth exemplary embodiment has slightly disadvantageous effects as compared with the third exemplary embodiment and the first exemplary embodiment. However, as compared to a PDP in which barrier rib members connected to the barrier rib member 16 of the display area DA are formed at both edges of the non-display area UD in the y-axis direction, the height of the phosphor mixed layer is reduced at the positions where the phosphor dispensing process starts and ends. As a result, it is possible to have more excellent effects.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A plasma display panel comprising:

a front substrate and a rear substrate facing each other;

address electrodes and display electrodes extending separately from each other in a first direction and a second direction, respectively, in a space between the front substrate and the rear substrate, the first direction crossing the second direction;

barrier ribs partitioning a display area, the display area including a plurality of discharge cells in the space between the front substrate and the rear substrate;

a phosphor layer in each of the plurality of discharge cells; and a non-display area along a periphery of the display area, wherein the non-display area comprises buffer areas in which a phosphor mixed layer having phosphors corresponding to different colors touch each other at a position below an upper surface of the barrier ribs.

2. The plasma display panel of claim 1, wherein the buffer areas are from a boundary of the display area to a fit line along a substrate edge where the rear substrate and the front substrate overlap each other.

3. The plasma display panel of claim 1, wherein the buffer areas are at both edges of the display area in the first direction.

4. The plasma display panel of claim 1, wherein the buffer area includes:

a first lateral barrier rib member in the second direction forming a boundary between itself and the display area, and a first longitudinal barrier rib member in the first direction and a second longitudinal barrier rib member in the first direction at both edges of the first lateral barrier rib member.

5. The plasma display panel of claim 1, wherein a height of the phosphor mixed layer applied in the buffer area is smaller than an average height of the barrier ribs.

6. The plasma display panel of claim 1, wherein a height of the phosphor mixed layer applied in the buffer area is reduced from a maximum height approaching the display area.

7. The plasma display panel of claim 1, wherein a height of the phosphor mixed layer applied in the buffer area is smaller than an average height of a longitudinal barrier rib member between the longitudinal barrier rib member and a lateral barrier rib member forming the barrier ribs in the display area.

8. The plasma display panel of claim 1, wherein starting and ending positions of phosphor paste application in a dispensing process are positioned in the buffer areas at both edges of the display area in the first direction, respectively.

9. A plasma display panel comprising:

a front substrate and a rear substrate facing each other;

address electrodes and display electrodes extending separately from each other in a first direction and a second direction, respectively, and crossing each other in a space between the front substrate and the rear substrate; baffler ribs forming a display area and partitioning a plurality of discharge cells in the space between the front substrate and the rear substrate; a phosphor layer in each of the plurality of discharge cells; and a non-display area along a periphery of the display area, wherein the non-display area comprises dummy cells having a width in the second direction that is larger than or equal to a combined width in the second direction of a pair of discharge cells.

10. The plasma display panel of claim 9, wherein the dummy cells comprise a phosphor mixed layer having phosphors corresponding to different colors touch each other at a position below an upper surface of the barrier ribs.

11. The plasma display panel of claim 10, wherein a height of the phosphor mixed layer is smaller than an average height of the barrier ribs.

12. The plasma display panel of claim 10, wherein proximal to the display area a height of the phosphor mixed layer is reduced from a maximum height.

13. The plasma display panel of claim 10, wherein starting and ending positions of phosphor paste application in a dispensing process are positioned in the dummy cells at both edges of the display area in the first direction, respectively.

14. A plasma display panel comprising:

a front substrate and a rear substrate facing each other;

address electrodes and display electrodes extending separately from each other in a first direction and a second direction, respectively, and crossing each other in a space between the front substrate and the rear substrate;

barrier ribs forming a display area and partitioning a plurality of discharge cells in the space between the front substrate and the rear substrate;

a phosphor layer in each of the plurality of discharge cells; and a non-display area along a periphery of the display area, wherein the non-display area comprises dummy cells having a width larger than or equal to a combined width of a pair of discharge cells, and wherein the dummy cells distal from the display area have a width larger than a width of the dummy cells proximal to the display area.

15. A plasma display panel comprising:

a front substrate and a rear substrate facing each other;

address electrodes and display electrodes extending separately from each other in a first direction and a second direction, respectively, and crossing each other in a space between the front substrate and the rear substrate;

barrier ribs forming a display area and partitioning a plurality of discharge cells in the space between the front substrate and the rear substrate;

a phosphor layer in each of the plurality of discharge cells; and a non-display area along a periphery of the display area, wherein the non-display area comprises:

first buffer areas formed of dummy cells adjacent to the display area, each dummy cell having a same width as a unit width of the discharge cells, second buffer areas formed of dummy cells adjacent to the first buffer areas, each dummy cell adjacent to the first buffer areas having a width larger than the width of each of the dummy cells included in the first buffer areas, and third buffer areas formed of dummy cells adjacent to the second buffer areas, each dummy cell adjacent to the second buffer areas having a width larger than the width of each of the dummy cells included in the second buffer areas.

16. The plasma display panel of claim 15, wherein each of the third buffer areas forms one dummy cell.

17. The plasma display panel of claim 15, wherein a length of each first buffer area in the first direction is equal to a length of the discharge cell of the display area in the first direction.

18. The plasma display panel of claim 15, wherein a length of each second buffer area in the first direction is equal to a length of the discharge cell of the display area in the first direction.

19. The plasma display panel of claim 15, wherein a length of each third buffer area in the first direction is larger than a length of the discharge cell of the display area in the first direction.

20. The plasma display panel of claim 15, wherein the third buffer areas are at both edges of the non-display area in the first direction.

21. The plasma display panel of claim 15, wherein starting and ending positions of phosphor paste application in a dispensing process are positioned in the third buffer areas at both edges of the non-display area in the first direction, respectively.

22. A plasma display panel comprising:

a front substrate and a rear substrate facing each other;

address electrodes and display electrodes extending separately from each other in a first direction and a second direction, respectively, in a space between the front substrate and the rear substrate, the first direction crossing the second direction;

barrier ribs partitioning a display area, the display area including a plurality of discharge cells in the space between the front substrate and the rear substrate;

a phosphor layer in each of the plurality of discharge cells; and a non-display area along a periphery of the display area, wherein the non-display area comprises buffer areas in which a phosphor mixed layer having phosphors corresponding to different colors touch each other at a position below an upper surface of the barrier ribs, and wherein:

the buffer areas comprise lateral barrier rib members in the second direction forming a boundary between the buffer areas and the display area;

the barrier ribs comprise display area longitudinal barrier rib members in the first direction; and the buffer areas comprise non-display area longitudinal barrier rib members in the first direction, wherein the number of non-display area longitudinal barrier rib members adjacent to the lateral barrier rib members is less than the number of display area longitudinal barrier rib members adjacent to the lateral barrier rib members.

* * * * *

UNITED STATES PATENT AND TRADEMARK OFFICE

CERTIFICATE OF CORRECTION

PATENT NO. : 7,683,544 B2
APPLICATION NO. : 11/529873
DATED : March 23, 2010
INVENTOR(S) : Seong-Hoon Han It is certified that error appears in the above-identified patent and that said Letters Patent is hereby corrected as shown below:

In the Claims

| | |
|---|---|
| Column 10, Claim 2, line 15 | Delete "fit"<br>Insert -- frit -- |
| Column 10, Claim 9, line 51 | Delete "baffler"<br>Insert -- barrier -- |

Signed and Sealed this
Eleventh Day of October, 2011

David J. Kappos

David J. Kappos
*Director of the United States Patent and Trademark Office*